US005811060A

United States Patent [19]

Laguna Valderrama

[11] Patent Number: 5,811,060

[45] Date of Patent: Sep. 22, 1998

[54] FLASK FOR TWO PRODUCTS

[75] Inventor: José Mª Laguna Valderrama, Barcelona, Spain

[73] Assignee: Laboratorios Inibsa, S.A., Llica de Vall, Spain

[21] Appl. No.: 673,736

[22] Filed: Jun. 27, 1996

[30] Foreign Application Priority Data

Jun. 28, 1995 [ES] Spain ..... 9501857

[51] Int. Cl.[6] ..... B01L 3/00

[52] U.S. Cl. ..... 422/102; 422/99; 422/104; 206/222; 215/DIG. 8

[58] Field of Search ..... 206/219, 222; 215/DIG. 8; 422/99, 102, 103, 104

[56] References Cited

U.S. PATENT DOCUMENTS

| | | | |
|---|---|---|---|
| 3,156,369 | 11/1964 | Bowes et al. | 215/DIG. 8 |
| 3,840,136 | 10/1974 | Lanfranconi et al. | 206/222 X |
| 3,968,872 | 7/1976 | Cacazza | 206/222 |
| 4,591,050 | 5/1986 | Finke et al. | 206/222 |
| 4,615,437 | 10/1986 | Finke et al. | 206/222 |
| 4,773,529 | 9/1988 | Finke et al. | 206/222 |
| 4,858,760 | 8/1989 | Di Sturco | 206/222 |
| 4,903,865 | 2/1990 | Janowitz | 222/83.5 |
| 5,038,951 | 8/1991 | Rizzardi | 215/256 |
| 5,041,267 | 8/1991 | Randtke et al. | 422/102 |
| 5,145,646 | 9/1992 | Tyranski | 422/102 |
| 5,543,097 | 8/1996 | Fang | 264/102 |

*Primary Examiner*—Harold Y. Pyon
*Attorney, Agent, or Firm*—Richard M. Goldberg

[57] ABSTRACT

A new flask for two products, includes a general flask body having a neck; a vessel housed inside the neck of the general flask body and having a weakened part; the neck of the flask body including a thread, and a flange at an upper part of the neck; a cap which screws onto an outside of the neck, the cap including a thread which is complementary to the thread on the neck, a flange which is complementary to the flange on the neck, a wall defining a hole, and a vertical projection which emerges from an inside of the cap, in the form of a short cylinder with extremely sharp edges, the length of the cylindrical vertical projection from the inside of the cap being such that the vertical projection facilitates cutting of the weakened part of the vessel, when the cap is screwed down; and a cover hinged to the cap and made from the same material as the cap, for fully sealing a top of the cap by pressure, the hinged cover of the cap having a central projection at a lower part thereof corresponding to the hole and of similar dimensions as the hole in the cap, such that the hinged cover forms an airtight seal with the hole.

10 Claims, 2 Drawing Sheets

FLASK FOR TWO PRODUCTS

BACKGROUND OF THE INVENTION

The present Invention refers to a new flask for two products, of the type which holds two products which must not come into contact with each other until the right moment. This flask type is characterised by the fact that it facilitates mixture of the two products at the right time, and by perfect sealing of the flask even after use.

SUMMARY OF THE INVENTION

The new flask promoted herein will be used preferably in the pharmaceutical and hospital fields, being especially designed for holding two liquid products —a base solution and activating solution—which must only be mixed at the time of use. To this purpose, they are completely separated from one another in the inside of the container. At the time of use, the mixture can be made with no need for either product to be touched.

This type of container is already available on the market, and in fact there are various solutions for achieving this end. However, in the case of the present invention, the mixing system incorporates a considerable innovation, since it involves breakage of the vessel which holds the activating solution. This is achieved thanks to a cutting area located in the cap which acts on a weakened area of the vessel, so that when the cap is turned, part of the vessel is pierced and then torn off. This piece falls into the liquid in the main body of the flask, and consequently the two products are mixed, leaving the dissolution ready for use.

The advantage of this new flask, defined according to the claims over those already existing on the market is derived not only from the fact that it cuts the vessel in a new way, but also because it presents the additional and essential advantage that the flask has a seal which forms part of the body of the cap. This means that when the flask has been used it can be resealed, which often represents an advantage over the flasks currently available on the market, depending on the type of use for which they are destined.

So, for example, one of the possible uses of this flask is that of holding the liquid used in renal dialysis. In this case, the liquid is provided for dialysis via a tube inserted into the flask when the two ingredients have been mixed. After dialysis, unpleasant gases remain inside the flask, making it necessary to dispose of the flasks immediately in the conventional way.

Now, in the case of the flask in question, since it has a seal that after using the product is tight sealed again, these flasks can be kept until the time of their disposal without any danger or discomfort for those working in the area.

In order to achieve its purpose, the flask holds a vessel in the inside of its neck which will hold the activating solution, while on the outside of the neck and above the cap thread appears a flange on the whole upper periphery. This and a small inner flange on the cap, permits that when the cap flange is higher than the neck flange, the cap is securely anchored in place and cannot be removed. However, it can be lodged and screwed downwards, allowing it to act on an area of the vessel in order to cut it, by means of an inside projection in the form of cylindrical crown. The assembly is completed by the fact that the said cap has a seal which, forming part of the same and having a hinge in the same material, can be used even after the flask has been used, leaving it sealed and airtight.

BRIEF DESCRIPTION OF THE DRAWINGS

In order to facilitate the explanation, a page of drawings is enclosed with the present statement, by way of illustration and not being in any way restrictive, representing an example of the new flask for two products, according to the principles set forth herein.

In the drawings.

DETAILED DESCRIPTION

As we can deduce from the drawings, the new flask for two products is constituted by a general body -1- which will hold a liquid product -2- inside, as well as a vessel -3- with the purpose of holding another liquid product -4-. The vessel is held in the inside neck -5- of the flask, supported by a flange -6- on the upper part of the neck, and has an intermediate perimetral area -7- at the height required to facilitate the cutting off and separation of the lower part of the vessel when the two liquids, -4- and -2-, are desired to be mixed in the main body of the flask -1- .

The neck -5- of the flask -1- has a thread -9- on the outside, as well as a flange -10- beside its mouth, both corresponding to the threads -11- and peripheral flange -12- on the inside of the cap -13-. Emerging from the upper face -14- of the cap, which has a hole -15- for letting the products out, is a projection in the form of a short cylinder -16-, the purpose of which is to facilitate the cutting of the vessel -3-. Finally, the cap assembly is closed by a cover -17- provided with a sealing element -18- and hinged -19- to the rest of the cap. The hinge is produced in the same material as the cap and cover, forming a single unit.

Viewing of the diagrams enclosed with the present description, with attention to the numbers indicated, will greatly facilitate understanding of the use of the new flask.

Figure 1:
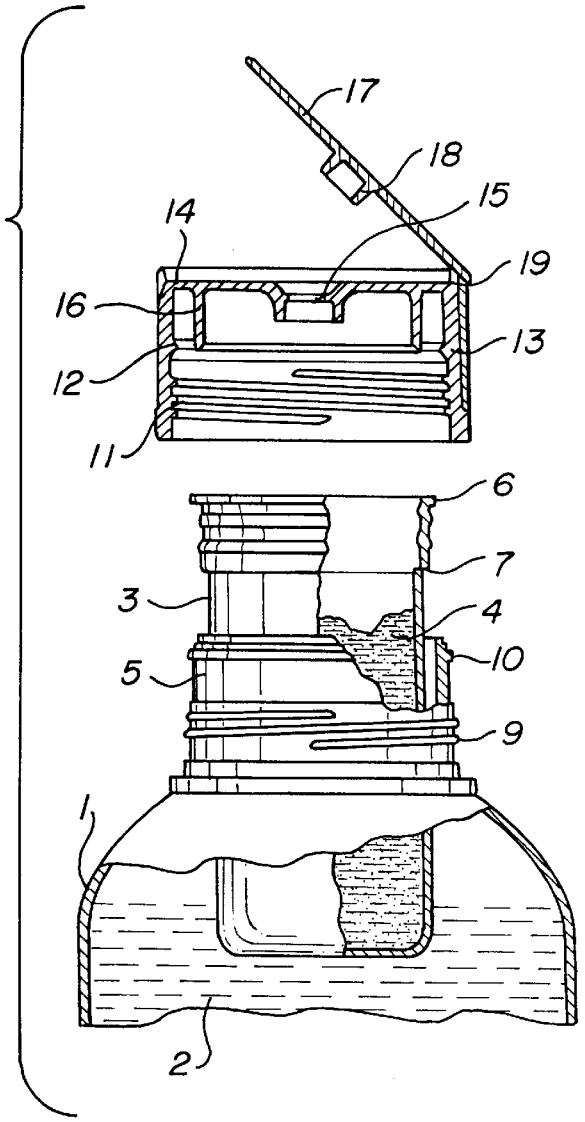
FIG. 1 shows a partly sectioned elevation view of the upper part of the new flask for two products, FIG. 2 being a top view.
Figure 2:
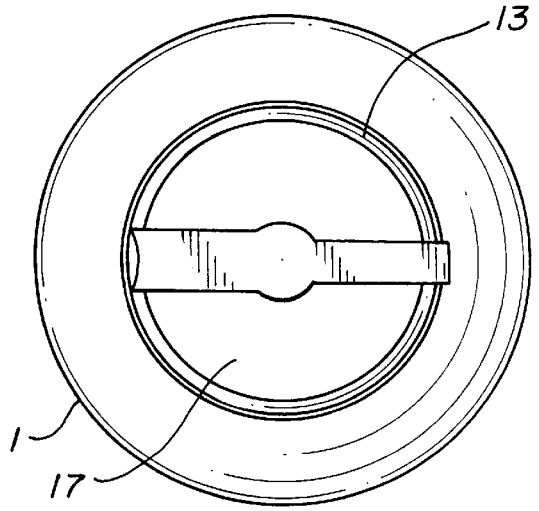
Figure 3:
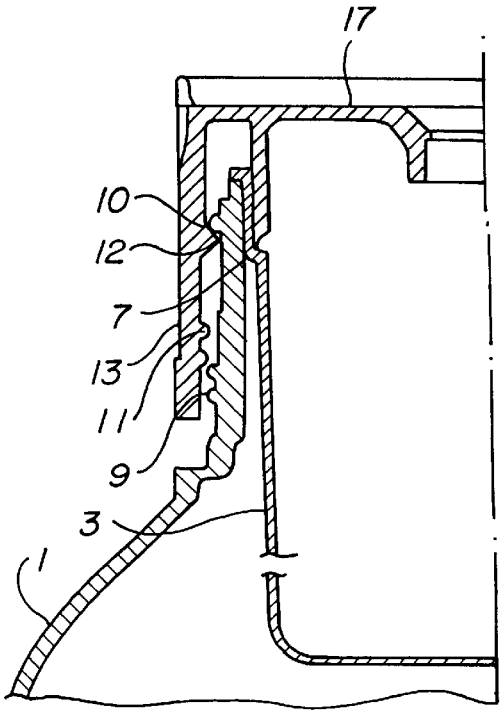
FIGS. 3 and 4 show different sections in elevation view of the upper part of the said flask, with two different positions of closure. In the second, we can observe the breakage of the vessel holding the activator solution.

In fact, FIG. 3 presents the cap assembly closed with the flask unused, in the storage phase, when the activator product -4- inside the vessel -3- is maintained completely separate from the liquid -2- inside the main body of the flask -1-.

Under these conditions, the cap -13- is in place in such a way that its flange -12- is lower than the flange -10- of the neck -5- of the flask and the cap is closed by pressure. The products are therefore perfectly sealed thanks to the position of the cover -17- and the complementary effect of elements -18- and -15-.

Figure 4:
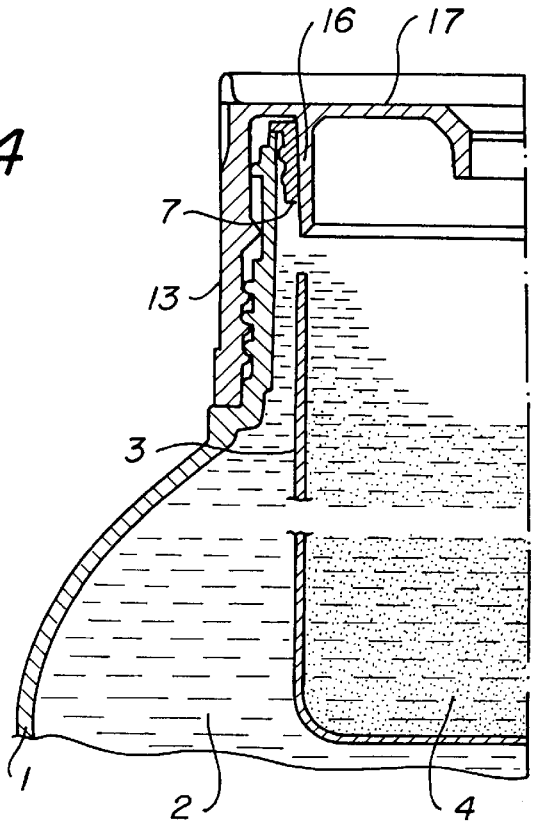

When the two liquids, -4- and -2-, are to be mixed for use, the cap -13- must simply be screwed around the neck -5- as shown in FIG. 4, causing the cylindrical projection -16- of the cap to cut the weakened area -7- of the vessel -3- until it is torn off, in turn leading to the complete mixture of the two products. At this stage, the whole unit is still sealed due to the effect of the cover -17- on the cap.

Once the said cover -17- has been opened, the dissolution obtained may be used as required. Subsequently, since the cover -17- is permanently joined to the cap assembly -13- by the hinge -19-, the flask can be definitively sealed in such a way that no unpleasant or harmful elements left inside the flask after use can escape. The flask can then be thrown out and eliminated at the right time, with no need to take special measures for rapid disposal.

I claim:

1. New flask for two products, comprising:

a general flask body having a neck;

a vessel housed inside the neck of the general flask body, the vessel having a weakened part, the neck of the flask body including:

an external thread, and a flange at an upper part of the neck; and a cap which screws onto an outside of said neck, said cap having a generally cylindrical configuration, with an upper end having a diameter similar to a diameter of the neck of the flask body, said cap including:

an internal thread which is complementary to the external thread on the neck, an inside flange which is complementary to the flange on the neck, a dispensing opening in an upper portion of the cap, a vertical projection which emerges from an inside of the cap, in the form of a short cylinder with extremely sharp edges, wherein the cylindrical vertical projection has a length from the inside of the cap such that the vertical projection facilitates cutting of the weakened part of the vessel, when the cap is initially screwed down with a first winding on the thread on the cap initially threadedly engaged with a first winding on the thread on the neck, and a cover hinged to the cap and made from the same material as the cap, for fully sealing the dispensing opening in the upper portion of the cap by pressure.

2. New flask for two products according to claim 1, in which:

the cap includes a wall defining the dispensing opening in the upper portion thereof;

the hinged cover of the cap includes a central projection at a lower part thereof corresponding to the dispensing opening and of similar dimensions as the dispensing opening in the cap, such that the hinged cover forms an airtight seal with the dispensing opening.

3. New flask for two products according to claim 1, in which the inside flange of the cap and the corresponding flange on the upper part of the neck of the flask body are of such a size that they overlap, preventing the cap from being removed from the flask body.

4. New flask for two products according to claim 1, comprising two stops for limiting downward movement of the cap on the flask body, one stop being defined by a shoulder on the flask body which is adapted to engaged with a lower edge of the cap to limit downward movement of the cap on the flask body, and the other stop being defined by an upper portion of the vessel which rests on an upper edge of said flask body and which is adapted to engage an undersurface of a top wall of the cap.

5. New flask for two products according to claim 1, wherein the vessel includes an upper flange which alone supports the vessel on an upper edge of the neck of the flask body.

6. New flask for two products, consisting essentially of:

a general flask body comprising a neck, said neck including:

an external thread, and a flange at an upper part of the neck;

a vessel having a weakened part, the vessel being housed inside the neck of the general flask body; and a cap having a generally cylindrical configuration, with an upper end having a diameter similar to a diameter of the neck of the flask body;

the cap being adapted to screw onto an outside of said neck, and including:

an internal thread which is complementary to the external thread on the neck, an inside flange which is complementary to the flange on the neck, a dispensing opening in an upper portion of the cap, a vertical projection which emerges from an inside of the cap, in the form of a short cylinder with extremely sharp edges, wherein the cylindrical vertical projection has a length from the inside of the cap such that the vertical projection facilitates cutting of the weakened part of the vessel, when the cap is initially screwed down with a first winding on the thread on the cap initially threadedly engaged with a first winding on the thread on the neck, and a cover hinged to the cap and made from the same material as the cap, for fully sealing the dispensing opening in the upper portion of the cap by pressure.

7. New flask for two products according to claim 6, in which:

the cap includes a wall defining the dispensing opening in the upper portion thereof;

the hinged cover of the cap includes a central projection at a lower part thereof corresponding to the dispensing opening and of similar dimensions as the dispensing opening in the cap, such that the hinged cover forms an airtight seal with the dispensing opening.

8. New flask for two products according to claim 6, in which the inside flange of the cap and the corresponding flange on the upper part of the neck of the flask body are of such a size that they overlap, preventing the cap from being removed from the flask body.

9. New flask for two products according to claim 6, comprising two stops for limiting downward movement of the cap on the flask body, one stop being defined by a shoulder on the flask body which is adapted to engaged with a lower edge of the cap to limit downward movement of the cap on the flask body, and the other stop being defined by an upper portion of the vessel which rests on an upper edge of said flask body and which is adapted to engage an undersurface of a top wall of the cap.

10. New flask for two products according to claim 6, wherein the vessel includes an upper flange which alone supports the vessel on an upper edge of the neck of the flask body.

* * * * *